US009176454B2

(12) United States Patent
Kurokawa et al.

(10) Patent No.: US 9,176,454 B2
(45) Date of Patent: Nov. 3, 2015

(54) ELECTROPHOTOGRAPHIC PHOTORECEPTOR

(71) Applicant: FUJI ELECTRIC CO., LTD., Kawasaki-shi (JP)

(72) Inventors: Keiichi Kurokawa, Matsumoto (JP); Yuji Ogawa, Matsumoto (JP)

(73) Assignee: FUJI ELECTRIC CO., LTD., Kawasaki-Shi (JP)

( * ) Notice: Subject to any disclaimer, the term of this patent is extended or adjusted under 35 U.S.C. 154(b) by 0 days.

(21) Appl. No.: 14/126,587

(22) PCT Filed: Sep. 28, 2012

(86) PCT No.: PCT/JP2012/006233

§ 371 (c)(1),
(2) Date: Dec. 16, 2013

(87) PCT Pub. No.: WO2013/140470

PCT Pub. Date: Sep. 26, 2013

(65) Prior Publication Data

US 2014/0133886 A1 May 15, 2014

(30) Foreign Application Priority Data

Mar. 19, 2012 (JP) ..... 2012-062354
May 2, 2012 (WO) ..... PCT/JP2012/002966

(51) Int. Cl.
*G03G 15/00* (2006.01)
*G03G 21/18* (2006.01)

(52) U.S. Cl.
CPC ..... *G03G 15/757* (2013.01); *G03G 21/186* (2013.01)

(58) Field of Classification Search
CPC ..... G03G 15/757; G03G 21/186
USPC ..... 399/167
See application file for complete search history.

(56) References Cited

U.S. PATENT DOCUMENTS 5,903,803 A 5/1999 Kawai et al.
6,169,866 B1 1/2001 Watanabe et al.

(Continued)

FOREIGN PATENT DOCUMENTS

CN 201174031 Y 12/2008
JP H08-262957 A 10/1996

(Continued)

OTHER PUBLICATIONS

JP 2001-324909 English translation, Karakama et al., Nov. 22, 2001.*

(Continued)

*Primary Examiner* — David Gray
*Assistant Examiner* — Thomas Giampaolo, II
(74) *Attorney, Agent, or Firm* — Rabin & Berdo, P.C.

(57) ABSTRACT

An electrophotographic photoreceptor is used by being detachably mounted onto an apparatus main body of an electrophotographic application apparatus while being incorporated in a process cartridge. The electrophotographic photoreceptor has a photosensitive drum formed by forming a photosensitive layer containing a photoconductive material on an outer circumferential surface of a cylindrical conductive substrate; and a flange that is fitted to an open end of the photosensitive drum and transmits a rotational driving force from the apparatus main body to the photosensitive drum. In the flange, on a surface thereof receiving the rotational driving force, a driven-side power transmission portion that is configured by a cylindrical body disposed concentrically with respect to a central shaft of the photosensitive drum, and engaging projections are provided.

15 Claims, 11 Drawing Sheets

(56) References Cited

U.S. PATENT DOCUMENTS

| | | | |
|---|---|---|---|
| 6,173,146 | B1 | 1/2001 | Wang et al. |
| 6,324,363 | B1 | 11/2001 | Watanabe et al. |
| 6,725,004 | B2 | 4/2004 | Ahn et al. |
| 7,813,676 | B2 | 10/2010 | Huck et al. |
| 2003/0059233 | A1 | 3/2003 | Jang et al. |
| 2007/0140735 | A1 | 6/2007 | Karz et al. |
| 2009/0010681 | A1 | 1/2009 | Huck et al. |
| 2010/0196047 | A1 | 8/2010 | Jin |
| 2010/0303501 | A1 | 12/2010 | Tsui |
| 2012/0051787 | A1 | 3/2012 | Lui |
| 2012/0257906 | A1 | 10/2012 | Zhao |
| 2013/0183063 | A1 | 7/2013 | Huck et al. |
| 2014/0133886 | A1 | 5/2014 | Kurokawa et al. |

FOREIGN PATENT DOCUMENTS

| | | | |
|---|---|---|---|
| JP | H08-328449 | A | 12/1996 |
| JP | 2001-324845 | A | 11/2001 |
| JP | 2001-324909 | A | 11/2001 |
| JP | 2003-148503 | A | 5/2003 |
| JP | 2010-144881 | A | 7/2010 |
| WO | WO 2009/000041 | A1 | 12/2008 |

OTHER PUBLICATIONS

European Search Report dated Dec. 15, 2014.

* cited by examiner

CROSS-SECTIONAL DIAGRAM TAKEN ALONG G-G

ELECTROPHOTOGRAPHIC PHOTORECEPTOR

TECHNICAL FIELD

The present invention relates to an electrophotographic photoreceptor (simply referred to as "photoreceptor" hereinafter). Specifically, the present invention relates to improvement of a gear flange and a flange which transmit a rotational driving force from an electrophotographic application apparatus to a photosensitive drum when incorporated in a process cartridge configuring the electrophotographic photoreceptor for use.

BACKGROUND ART

An electrophotographic photoreceptor generally has a flange or a gear flange coupled to either end of a photosensitive drum formed by forming a photosensitive layer on an outer circumferential surface of a conductive substrate. Such photoreceptor is installed in a process cartridge, which is then mounted in an electrophotographic application apparatus such as a copier, a printer, or a facsimile.

The process cartridge is a form of cartridge in which a charging member for direct voltage application (including neutralization) and various other members for performing electrophotographic processes such as development and cleaning are disposed around an electrophotographic photoreceptor and integrally stored. The process cartridge is detachably mounted on an electrophotographic application apparatus and serves a central function in image formation.

An electrophotographic application apparatus mounted with a process cartridge first forms a latent image by exposing an electrophotographic photoreceptor to light in response to image information, the electrophotographic photoreceptor being charged evenly in a charging process. Next, the latent image is developed in a developing process using toner, to form a toner image on the photoreceptor. Further, the toner image is transferred onto a base such as a piece of paper in a transfer process, thereby executing image formation.

The process cartridge system described above has conventionally been used widely in electrophotographic application apparatuses using electrophotographic processes. One of the advantages of such process cartridge is that it almost eliminates need to perform maintenance on the apparatus main body, making the maintainability of the apparatus very simple.

Incidentally, a process cartridge accomplishes the electrophotographic processes by causing the electrophotographic photoreceptor to rotate in response to the rotational driving force from the apparatus main body. In order to transmit the driving force, a flange with a gear or a flange is generally coupled to an edge of the photosensitive drum.

When the gear flange or flange coupled to the photosensitive drum falls off the photoreceptor, or when the coupling portion therebetween is loosened, the driving force is not transmitted, and therefore the rotation of the photoreceptor stops, stopping the function of the apparatus or causing serious accidents such as jittering and other types of image failure. An important technical subject is to ensure long-term reliability in the coupling portion between the gear flange or flange and the photosensitive drum, so that the gear flange or flange is prevented from falling off the photoreceptor or being loosened in the coupling portion.

In addition, poor fitting accuracy between a driven-side power transmission portion of the flange and a drive-side power transmission portion of the apparatus main body disables the transmission of the driving force, resulting in image failure. It is, therefore, important to reliably couple the flange and the photosensitive drum to each other and to keep high rotational accuracy over a long period of time by accomplishing an optimum fitting state in the drive-side power transmission portion and thereby reliably transmitting the rotational driving force.

Regarding the improvement of the driven-side power transmission portion of the flange, Patent Document 1, for example, discloses a technology of improving the rotational accuracy of a photosensitive drum by providing an apparatus main body gear with a predetermined twisted hole, providing one end of the electrophotographic photosensitive drum in a longitudinal direction with a twisted projection, and fitting the twisted hole and the twisted projection together to transmit the rotational driving force.

Patent Document 2 discloses a technology of reliably transmitting the driving force and preventing vibration of the process cartridge by coupling the apparatus main body and the process cartridge to each other by means of a coupling hole and coupling projection of the apparatus main body gear, as well as a projection and an abutting portion coming into external abutment with the projection, which are provided in the apparatus main body and the process cartridge.

Patent Document 3 discloses a technology concerning a developing cylinder with a driven-side power transmission portion of a flange, the shape of the driven-side power transmission portion being improved, and a drive gear, the technology aiming to promptly execute molding of the driven-side power transmission portion.

Patent Document 1: Japanese Patent Application Publication No. H8-328449 (claims, etc.)

Patent Document 2: Japanese Patent Application Publication No. 2001-324845 (claims, etc.)

Patent Document 3: U.S. Pat. No. 6,173,146 (Description)

DISCLOSURE OF THE INVENTION

The structure of the driven-side power transmission portion of the flange has been examined in various ways as described above, and it is desirable to realize a highly practical flange by enhancing rotational transmission force upon driving, long-term reliability of the rotational accuracy, and cost performance.

Because the rotational direction of the drive-side power transmission portion of the apparatus main body of the electrophotographic application apparatus varies depending upon the specification of the apparatus main body, the shapes of the drive-side power transmission portion and the driven-side power transmission portion need to be changed in accordance with the rotational direction. For this reason, various types of driven-side power transmission portions need to be created in accordance with the shape of the drive-side power transmission portion. Thus, compatible and highly durable driven-side power transmission portions are required.

An object of the present invention is to provide an electrophotographic photoreceptor which not only is capable of exhibiting enhanced rotational accuracy, keeping the rotational accuracy over a long period of time, and transmitting power regardless of the rotational direction of the drive-side power transmission portion when used in an actual machine, but also is excellent in terms of production cost.

In order to achieve the object described above, one aspect of an electrophotographic photoreceptor of the present invention is an electrophotographic photoreceptor, which is used by being detachably mounted onto an apparatus main body of an electrophotographic application apparatus while being incorporated in a process cartridge. The electrophotographic photoreceptor has a photosensitive drum formed by forming a photosensitive layer containing a photoconductive material on an outer circumferential surface of a cylindrical conductive substrate, and a gear flange or a flange that is fitted to an edge of the photosensitive drum and transmits a rotational driving force from a drive-side power transmission portion disposed in the apparatus main body to the photosensitive drum.

The gear flange or flange has a driven-side power transmission portion that has a cylindrical body with a central shaft of the photosensitive drum as a core, the cylindrical body being formed in such a manner as to protrude from a driving force receiving portion receiving the rotational driving force, and a plurality of hemispherical engaging projections that are disposed at trisection points on an outer circumference of the cylindrical body in such a manner as to protrude in a radially outward direction from the outer circumference, away from the driving force receiving portion, and that come into engagement with the drive-side power transmission portion.

According to one aspect of the present invention, the driven-side power transmission portion has a plurality of spherical engaging projections that are disposed at trisection points on the outer circumference of the cylindrical body and project radially outward from the outer circumference, away from the driving force receiving portion, the cylindrical body having the central shaft of the photosensitive drum as a core. Therefore, mountability and fittability of the engaging projections to the engaging hole of the drive-side power transmission portion can be improved. Furthermore, rotational accuracy and rotational strength of the drive-side power transmission portion during a printing process can also be enhanced regardless of the rotational direction of the drive-side power transmission portion. In addition, the electrophotographic photoreceptor according to the present invention can be excellent in terms of production cost.

BEST MODE FOR CARRYING OUT THE INVENTION

Embodiments of the present invention are now described hereinafter.

Figure 1:
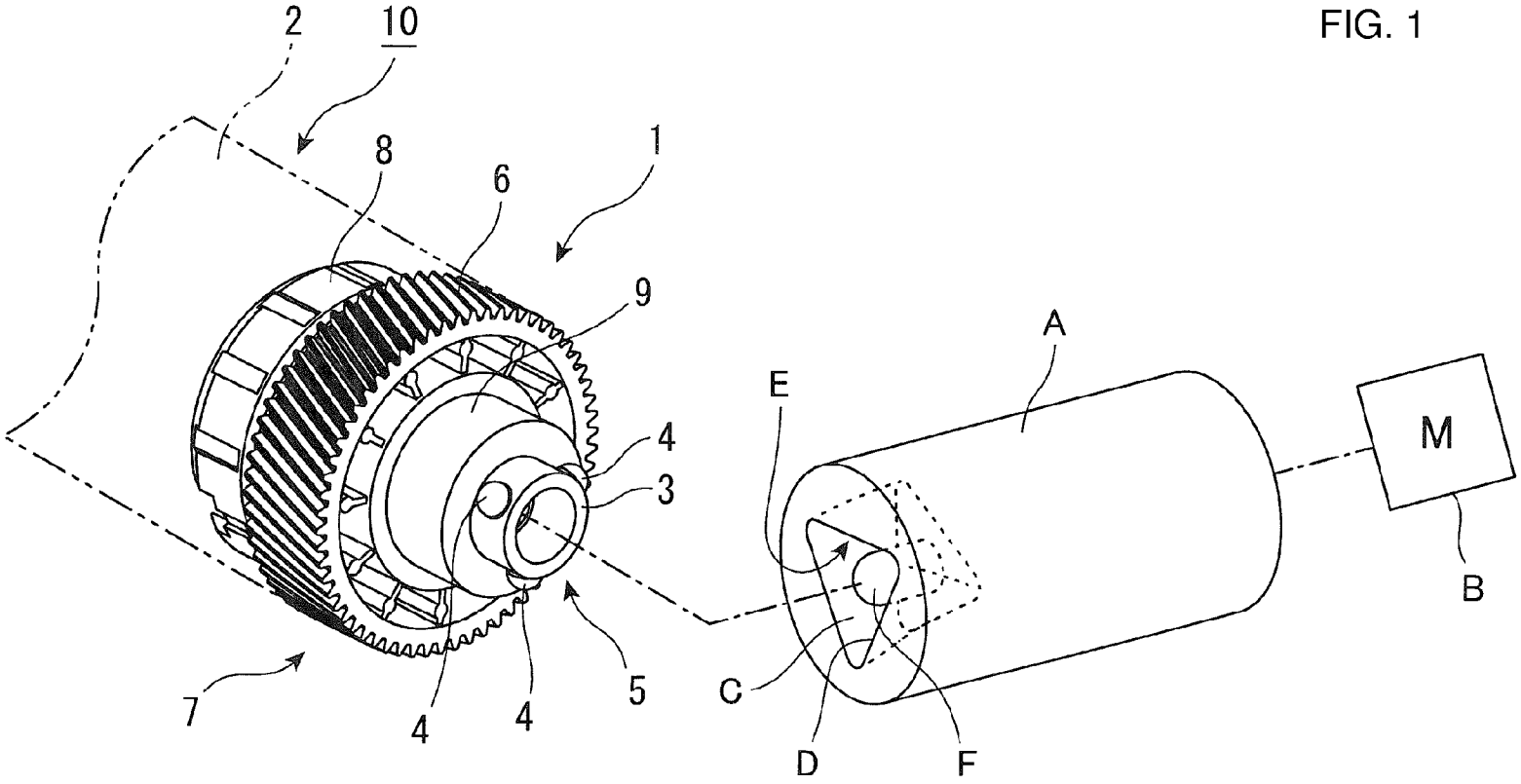
FIG. 1 is a perspective view showing partial enlargements of an electrophotographic photoreceptor, an apparatus drive shaft, and an electric motor according to the present invention.
Figure 2:
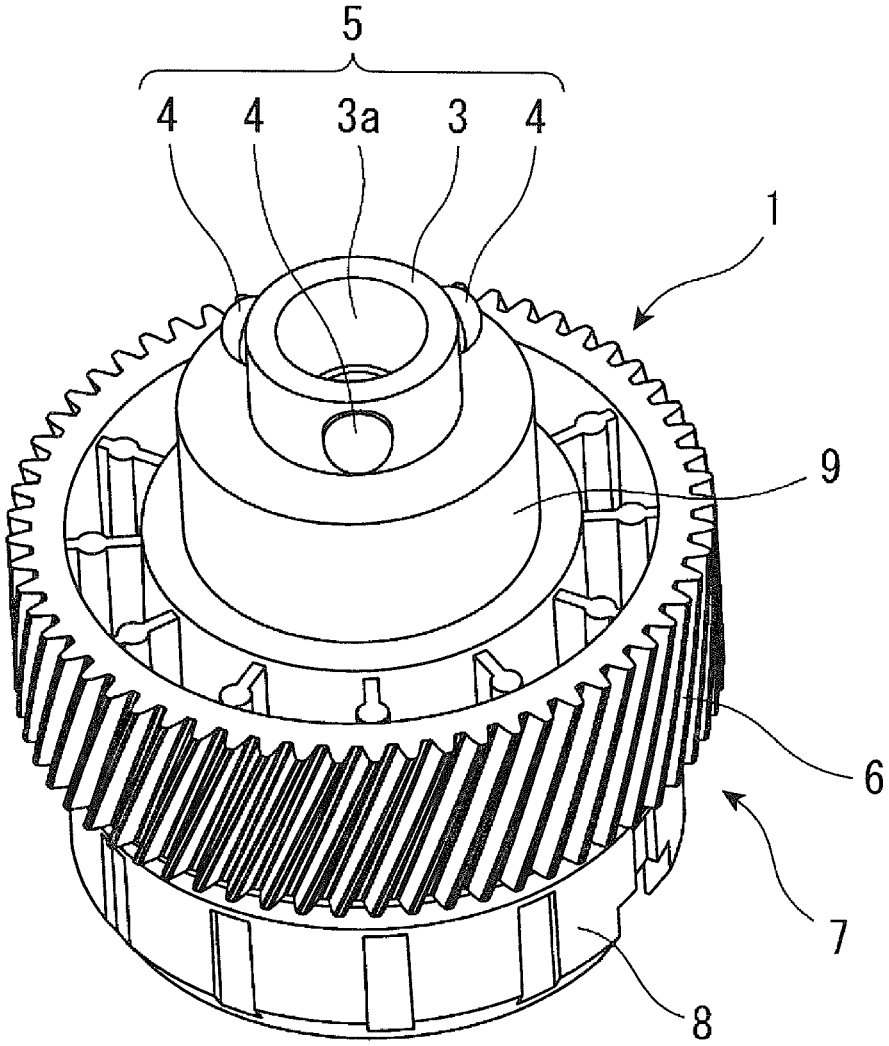
FIG. 2 is a perspective view showing a gear flange of a first embodiment according to the present invention.
Figure 3A:
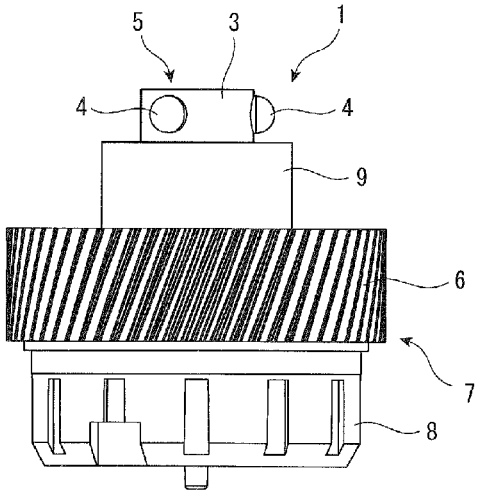
FIG. 3 shows the gear flange of the first embodiment according to the present invention, where FIG. 3(*a*) is a side view, FIG. 3(*b*-1) is a front view, and FIG. 3(*b*-2) is an arrow view taken along line G-G of diagram FIG. 3(*b*-1)
Figure 3A:
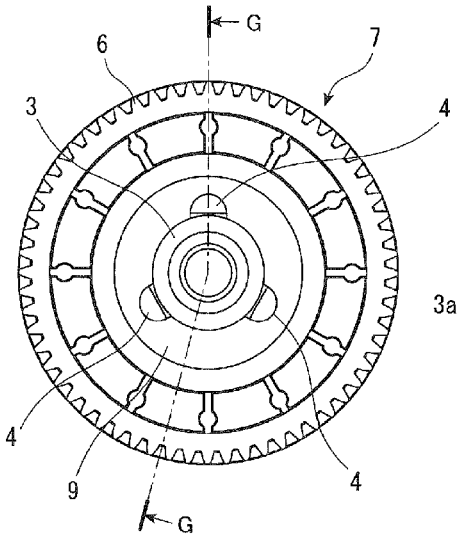
Figure 3A:
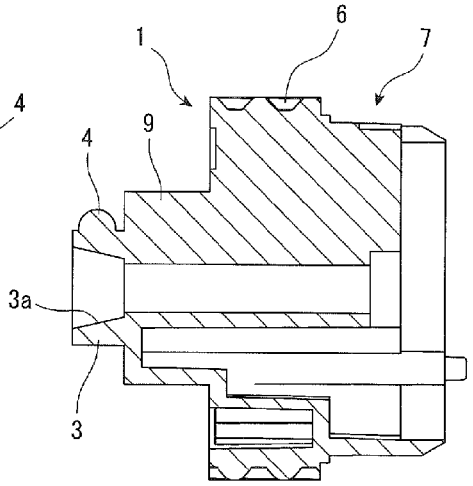

FIG. 1 is a perspective view showing an enlargement of an edge of an electrophotographic photoreceptor according to the present invention. FIG. 2 is a perspective view showing a gear flange of a first embodiment according to the present invention. FIG. 3(*a*) is a side view of the gear flange of the first embodiment. FIG. 3(*b*-1) is a front view of the gear flange of the first embodiment. FIG. 3(*b*-2) is an arrow view taken along line G-G of FIG. 3(*b*-1).

An electrophotographic photoreceptor 10 of the present invention is a photoreceptor for a process cartridge, which is used by being detachably mounted onto an apparatus main body of an electrophotographic application apparatus while being incorporated in a process cartridge. As shown in this diagram, the electrophotographic photoreceptor 10 has a photosensitive drum 2 and a gear flange 1 of the first embodiment which is fitted to an open end of the photosensitive drum 2.

The gear flange 1 of the present embodiment transmits a rotational driving force from an apparatus drive shaft A of the apparatus main body to the photosensitive drum 2. An electrophotographic process is executed by the rotating photosensitive drum 2. The apparatus drive shaft A is coupled to a rotating shaft of an electric motor B via a predetermined power transmission mechanism (not shown) such as a speed reducer, and is driven to rotate in a certain direction. An engaging hole C configuring a drive-side power transmission portion is formed on a front edge surface of the apparatus drive shaft A. This engaging hole C has a triangular opening portion D at an end face of the front edge surface of the apparatus drive shaft A. From this opening portion D, the engaging hole C extends toward the rear end side of the apparatus drive shaft A and has a triangular cross-sectional shape. The engaging hole C is twisted into a spiral in, for example, a counterclockwise direction, as shown in FIG. 1. Consequently, guide surfaces E forming a spiral are formed on the back of the opening portion D. Note that the three corners of the triangular opening portion D are rounded in such a manner as to obtain a substantially triangular opening.

The center of a bottom of the twisted engaging hole C is provided with an alignment projection F.

It is important to note that a driven-side power transmission portion 5 is formed on a driving force receiving portion 9 that receives the rotational driving force of the gear flange 1 in the electrophotographic photoreceptor 10.

As shown in FIG. 2, the driven-side power transmission portion 5 has a cylindrical body 3 provided as a central (rotating) shaft of the photosensitive drum 2 in such a manner as to protrude from the part of the gear flange 1 which receives the rotational driving force, and three engaging projections 4 that are disposed at, for example, trisection points, the points being obtained by substantially equal division into three in the axial direction, on an outer circumferential surface of the cylindrical body 3.

The gear flange 1 of the present embodiment has a flange main body 7 having a gear 6 on its outer circumferential portion. This flange main body 7 has a fitting portion 8 on the back, the fitting portion 8 being fitted to an open end face of the photosensitive drum 2. The cylindrical body 3 and the plurality of engaging projections 4 are formed on an end face of the cylindrical driving force receiving portion 9 that is formed across the gear 6 from the fitting portion 8.

Figure 4:
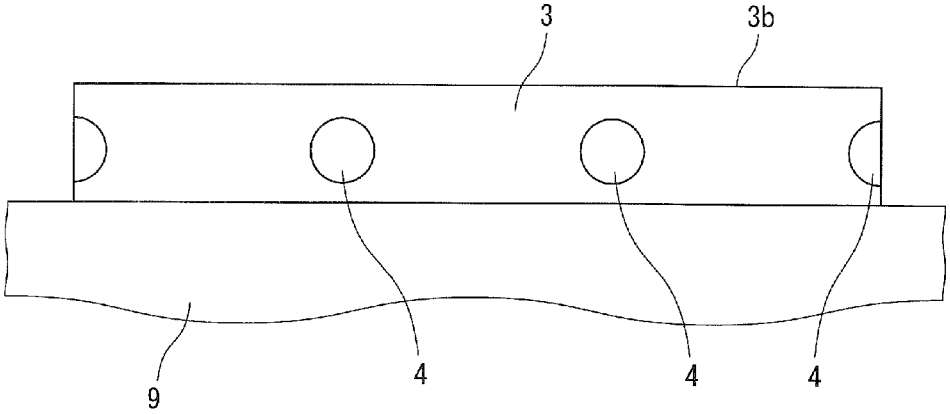
FIG. 4 is a development view showing a cylindrical body of the gear flange of the first embodiment according to the present invention.
Figure 5A:
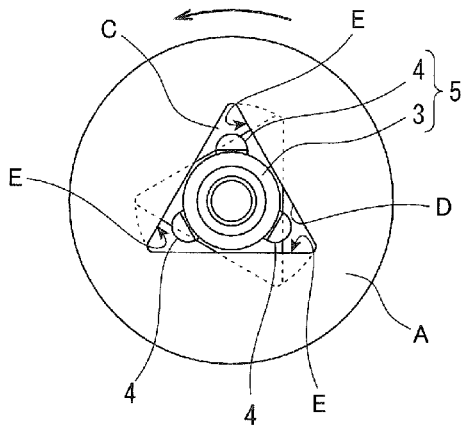
FIG. 5 is an explanatory diagram for explaining operations executed in the first embodiment according to the present invention.
Figure 5B:
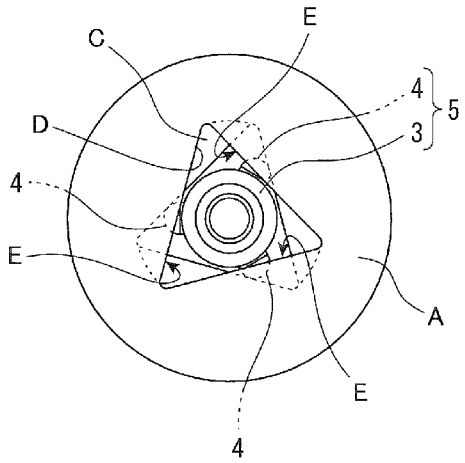
Figure 5C:
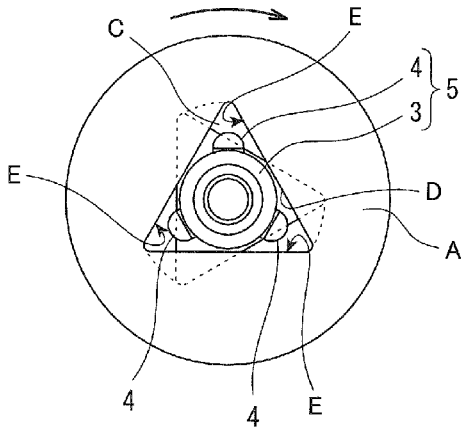
Figure 5D:
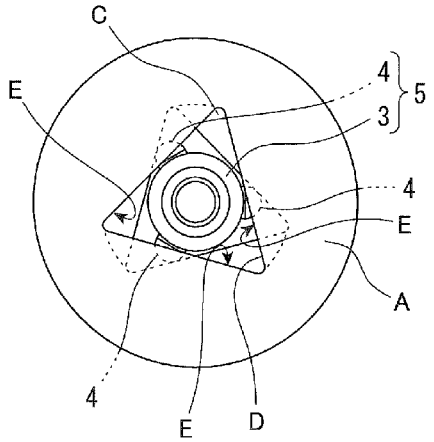

As shown in FIG. 3, the plurality of engaging projections 4 protrude radially outward (e.g., in a direction perpendicular to the central axis of the cylindrical body 3) from an outer circumference of the cylindrical body 3, away from the driving force receiving portion 9. The planar shape of the engaging projections 4 is shaped into a substantially perfectly circular hemisphere as viewed radially outward. Further, as shown in FIG. 4, all of the engaging projections 4 are located on the same level with respect to a front edge 3*b* of the cylindrical body 3.

As shown in FIG. 3(*b*-2), an inner circumferential surface 3*a* of the cylindrical body 3 is so shaped as to be attachable/detachable with respect to the alignment projection F provided at the center of the bottom of the twisted engaging hole C.

The rotational driving force is transmitted from the drive-side power transmission portion, mainly via each of the engaging projections 4. The design of the gear flange 1 can be simplified by forming the engaging projections 4 in such a manner that these projections protrude radially outward from the outer circumference of the cylindrical body 3, away from the driving force receiving portion 9. The simplified design of the gear flange 1 can facilitate easy injection molding of the gear flange 1 and reduction of the associated costs. There may be at least one engaging projection 4, but it is preferred to provide three engaging projections 4 in a circumferential direction.

As shown in FIG. 3, because the planar shape of the engaging projections 4 is shaped into a substantially perfectly circular hemisphere as viewed radially outward, the engaging projections 4 can come into engagement with the guide surfaces E that are formed on the back of the opening portion D, ensuring the strength against the rotation caused upon transmission of the driving force, the opening portion D being provided as the entrance of the twisted engaging hole C having a triangular cross section and configuring the drive-side power transmission portion of the apparatus main body.

Next, an operation for coupling the gear flange 1 and the apparatus drive shaft A according to the present embodiment is described. Suppose that, as shown in FIGS. 5(*a*) and 5(*b*), the triangular engaging hole C of the apparatus drive shaft A is twisted gradually in a clockwise direction toward the rear end side of the apparatus drive shaft A from the opening portion D.

Here is described a case where the process cartridge, incorporating the electrophotographic photoreceptor 10, is mounted in the apparatus main body of the electrophotographic application apparatus. First, when the apparatus drive shaft A is rotated in the counterclockwise direction using the electric motor, a shaft center of the driven-side power transmission portion 5 and a shaft center of the triangular twisted engaging hole C coincide with each other, as shown in FIG. 5(*a*), the driven-side power transmission portion 5 being configured by the cylindrical body 3 and the engaging projections 4, and the engaging hole C being formed at the front edge of the apparatus drive shaft A. Consequently, as the apparatus drive shaft A moves toward the gear flange 1, the apparatus drive shaft A is coupled to the gear flange 1.

Because the apparatus drive shaft A is driven to rotate in the counterclockwise direction, the cylindrical body 3 and the engaging projections 4 are gradually inserted to the bottom of the twisted engaging hole C, depending on the degree of twisting of the twisted engaging hole C. When or immediately before the front edge of the cylindrical body 3 reaches a bottom face of the twisted engaging hole C, as shown in FIG. 5(*b*), outer circumferential surfaces around base portions of the engaging projections 4 come into abutment with the guide surfaces E formed on the back of the opening portion D of the twisted engaging hole C, as shown in FIG. 5(*b*). As a result, the rotational driving force of the apparatus drive shaft A is transmitted from an inner wall of the opening portion D of the twisted engaging hole C to the three engaging projections 4, and is then transmitted to the gear flange 1 via the cylindrical body 3. The rotational driving force is then transmitted from the gear flange 1 to the photosensitive drum 2 fitted thereto.

When the twisted engaging hole C of the apparatus drive shaft A is gradually twisted in the counterclockwise direction toward the far side from the opening portion D, as shown in FIGS. 5(*c*) and 5(*d*), the apparatus drive shaft A is driven to rotate in the clockwise direction, as shown in FIG. 5(*c*).

In this case, the twisted engaging hole C and the driven-side power transmission portion 5 start being coupled to each other as the apparatus drive shaft A moves toward the gear flange 1, as soon as the shaft center of the driven-side power transmission portion 5 and the shaft center of the triangular twisted engaging hole C coincide with each other, as shown in FIG. 5(*c*), the driven-side power transmission portion 5 being configured by the cylindrical body 3 and the engaging projections 4, and the twisted engaging hole C being formed at the front edge of the apparatus drive shaft A.

Because the apparatus drive shaft A is driven to rotate in the clockwise direction, the cylindrical body 3 and the engaging projections 4 are gradually inserted to the bottom of the twisted engaging hole C, depending on the degree of twisting of the twisted engaging hole C. When or immediately before the front edge of the cylindrical body 3 reaches the bottom face of the twisted engaging hole C, as shown in FIG. 5(*d*), the outer circumferential surfaces around the base portions of the engaging projections 4 come into abutment with the guide surfaces E formed on the back of the opening portion D of the twisted engaging hole C, as shown in FIG. 5(*d*). As a result, the rotational driving force of the apparatus drive shaft A is transmitted from the guide surfaces E formed on the back of the opening portion D of the twisted engaging hole C to the three engaging projections 4, and is then transmitted to the gear flange 1 via the cylindrical body 3. The rotational driving force is then transmitted from the gear flange 1 to the photosensitive drum 2 fitted thereto.

According to the present embodiment, both when the twisted engaging hole C of the apparatus drive shaft A is twisted in the clockwise direction so that the apparatus drive shaft A is driven to rotate in the counterclockwise direction, and when the twisted engaging hole C of the apparatus drive shaft A is twisted in the counterclockwise direction so that the apparatus drive shaft A is driven to rotate in the clockwise direction, the engaging projections 4 of the driven-side power transmission portion 5 can securely come into engagement with the twisted engaging hole C.

Furthermore, according to the present embodiment, the front edge of the cylindrical body 3 reaches the bottom of the twisted engaging hole C, as a result of driving and rotating the apparatus drive shaft A using the electric motor B while pushing the apparatus drive shaft A against the cylindrical body 3. In so doing, the cylindrical body 3 is inserted into the twisted engaging hole C as the three engaging projections 4 of the driven-side power transmission portion 5 come into point-contact with the guide surfaces E on the inside of the triangular opening portion D of the twisted engaging hole C. In this manner, the cylindrical body 3 can easily be passed through the twisted engaging hole C with less sliding friction. Moreover, inserting front edges of the engaging projections 4 into the twisted engaging hole C can bring about a pulling effect.

In a state in which the front edge of the cylindrical body 3 reaches the bottom of the twisted engaging hole C, the curved surface of each of the engaging projections 4, which has a substantially perfectly circular hemispherical planar shape as viewed radially outward, remains in point-contact with each of the guide surfaces E on the back of the triangular opening portion D of the twisted engaging hole C. For this reason, the rotational driving force of the apparatus drive shaft A can be transmitted to the gear flange 1 via the driven-side power transmission portion 5 configured by the engaging projections 4 and the cylindrical body 3. The photosensitive drum 2 can be driven to rotate thereby.

In addition, the inner circumferential surface 3*a* of the cylindrical body 3 is so shaped as to be attachable/detachable with respect to the alignment projection F provided in the bottom of the twisted engaging hole C, so that the plurality of engaging projections 4 can securely transmit the rotational driving force to the photosensitive drum 2 without causing misalignment of the central axis of the cylindrical body 3. In other words, rotational accuracy can be ensured by bringing the inner circumferential surface 3*a* of the cylindrical body 3 into engagement with the alignment projection F provided at the center of the bottom of the twisted engaging hole C of the apparatus drive shaft A and adjusting the core of the cylindrical body 3.

As long as the aforementioned requirements concerning the gear flange 1 are satisfied, a desired effect can be achieved. The material, structure, and other configurations of the gear flange 1 are not particularly limited, but the following configurations can be employed.

Examples of the material for the gear flange 1 include polycarbonate, polyacetal, polyamide, polybutylene terephthalate, and various other general resin materials. A combination of one or two or more of these materials can appropriately be used.

The photosensitive drum 2 is configured by forming a photosensitive layer on an outer circumferential surface of a cylindrical conductive substrate (simply referred to as "substrate" hereinafter), the photosensitive layer containing a photoconductive material. In the present invention, any materials can be used for the substrate and the photosensitive layer as long as the materials satisfy the required characteristics of a photoreceptor. Examples of the material of the substrate include aluminum, aluminum alloy, and a material obtained by vapor-depositing an aluminum film on a cylindrical plastic surface. Regarding the photoconductive material of the photosensitive layer, known charge-generating materials such as various phthalocyanine compounds and known charge-transporting materials such as hydrazone compounds can be used. The photosensitive layer is formed by a known method such as a dip-coating method in which a charge-transporting material and other additive are dispersed or dissolved in a binder in accordance with the layer configuration. The photosensitive layer may be formed by stacking a charge-generating layer and a charge-transporting layer or may be a single layer. Alternatively, an underlayer may be formed between the substrate and the photosensitive layer.

Figure 6A:
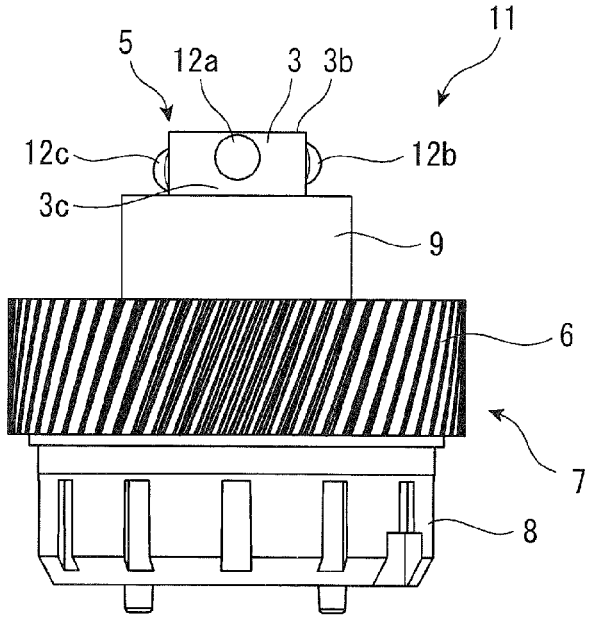
FIG. 6 shows a gear flange of a second embodiment according to the present invention, where FIG. 6(*a*) is a side view and FIG. 6(*b*) is a front view.
Figure 6B:
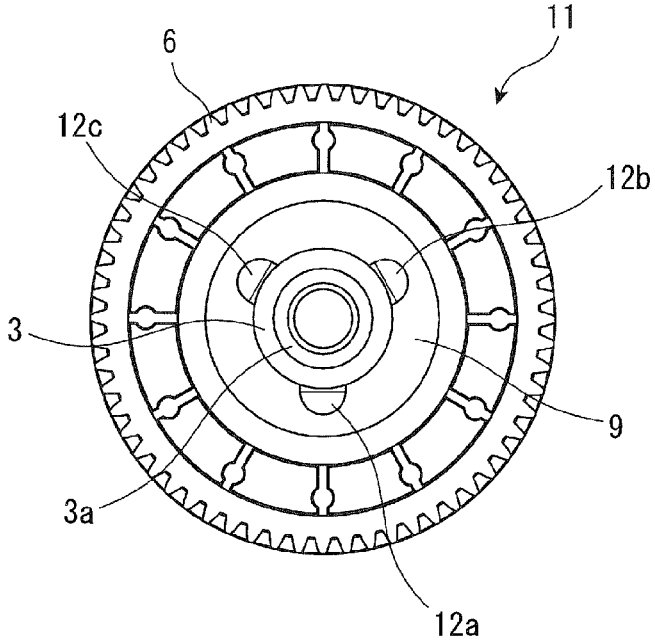
Figure 7:
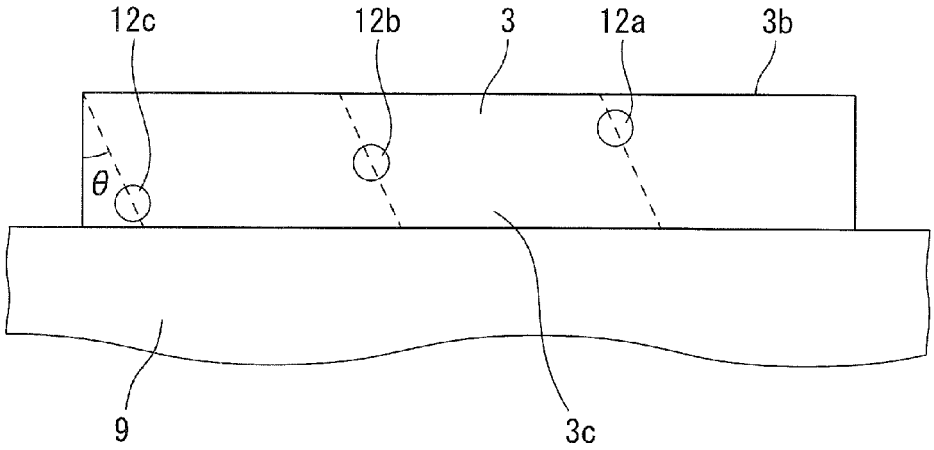
FIG. 7 is a development view showing the cylindrical body of the gear flange of the second embodiment according to the present invention.

FIGS. 6 and 7 show a gear flange 11 of a second embodiment according to the present invention. FIG. 6(*a*) is a side view of the gear flange 11, and FIG. 6(*b*) is a front view of the gear flange 11. FIG. 7 is a development view of the cylindrical body 3 of the gear flange 11. Note that the same components as those described with reference to FIGS. 1 to 5 are denoted with the same reference numerals, and description thereof is omitted.

The driven-side power transmission portion 5 on the driving force receiving portion 9 of the gear flange 11 according to the present embodiment has the cylindrical body 3 and three engaging projections, first to third engaging projections 12*a*, 12*b*, and 12*c*.

The first to third engaging projections 12*a*, 12*b*, and 12*c* are disposed at, for example, trisection points, the points being obtained by substantially equal division into three in the axial direction (the central shaft of the photosensitive drum 2), on the outer circumferential surface of the cylindrical body 3. The first to third engaging projections 12*a*, 12*b*, and 12*c* protrude radially outward from the outer circumference of the cylindrical body 3, away from the driving force receiving portion 9. The planar shape of the first to third engaging projections 12*a*, 12*b*, and 12*c* is shaped into a substantially perfectly circular hemisphere as viewed radially outward. Furthermore, as shown in FIG. 7, the first to third engaging projections 12*a*, 12*b*, and 12*c* are formed on the twisted engaging hole C at a pitch θ. The first engaging projection 12*a* is formed near the front edge 3*b* of the cylindrical body 3. The second engaging projection 12*b* is formed at a position away from the front edge 3*b*, in the vicinity of which the second engaging projection 12*a* is formed. The third engaging projection 12*c* is formed near a base portion 3*c* of the cylindrical body 3. Three arrangement angles are set as follows in accordance with the levels at which these engaging projections are formed. In other words, the angle between the first engaging projection 12*a* and the second engaging projection 12*b* in the axial direction is 122° to 123°. The angle between the second engaging projection 12*b* and the third engaging projection 12*c* is 123.3° to 125.0°. The angle between the third engaging projection 12*c* and the first engaging projection 12*a* is 112.0° to 115.0°. These angles are set based on the levels of the projections.

According to the present embodiment, the front edge 3*b* of the cylindrical body 3 reaches the bottom of the twisted engaging hole C, as a result of driving and rotating the apparatus drive shaft A using the electric motor B while pushing the apparatus drive shaft A against the cylindrical body 3.

In so doing, the cylindrical body 3 is inserted into the twisted engaging hole C as the curved surfaces of the first to third engaging projections 12*a* to 12*c* come into point-contact with the guide surfaces E on the inside of the triangular opening portion D of the twisted engaging hole C, the first to third engaging projections 12*a* to 12*c* being formed in different distances from the front edge 3*b* of the cylindrical body 3 in the driven-side power transmission portion 5. In this manner, the cylindrical body 3 can easily be passed through the twisted engaging hole C with less sliding friction.

Moreover, inserting the first engaging projection 12*a* into the twisted engaging hole C can bring about the pulling effect.

In a state in which the front edge of the cylindrical body 3 reaches the bottom of the twisted engaging hole C, the engaging projections 12*a* to 12*c* that have a substantially perfectly circular hemispherical planar shape as viewed radially outward remain in point-contact with the guide surfaces E on the back of the triangular opening portion D of the twisted engaging hole C. For this reason, the rotational driving force of the apparatus drive shaft A can be transmitted to the gear flange 11 via the driven-side power transmission portion 5 configured by the first to third engaging projections 12*a* to 12*c* and the cylindrical body 3. The photosensitive drum 2 can be driven to rotate thereby.

Figure 8A:
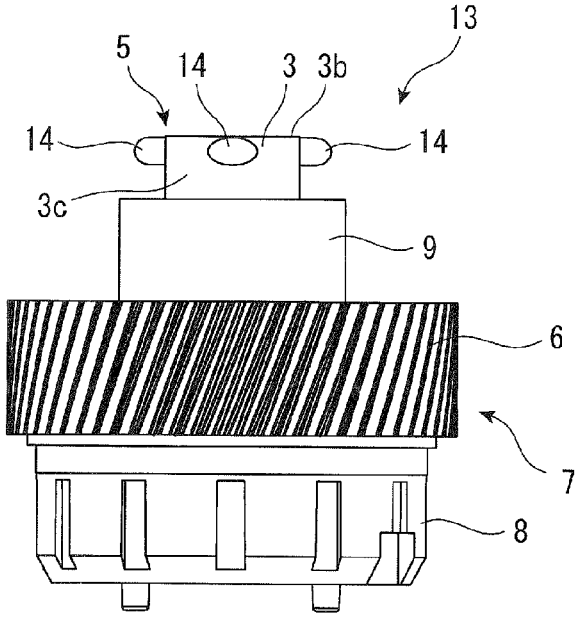
FIG. 8 shows a gear flange of a third embodiment of the present invention, where FIG. 8(*a*) is a side view and FIG. 8(*b*) is a front view.
Figure 8B:
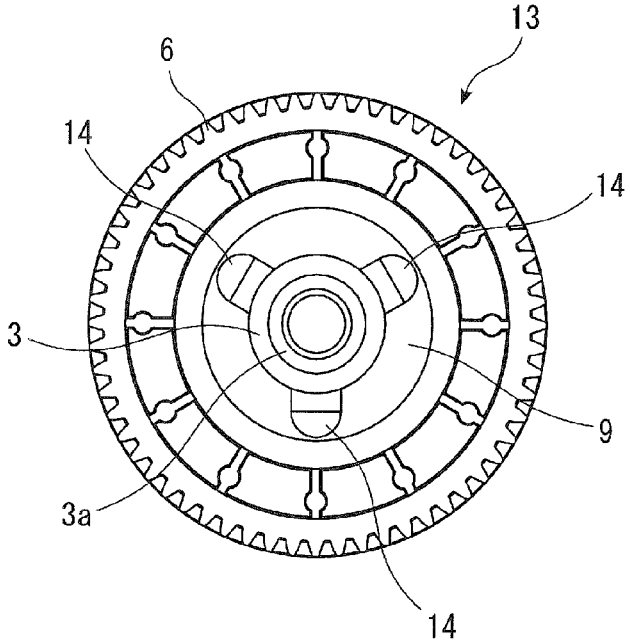

FIGS. 8(*a*) and 8(*b*) are diagrams showing a gear flange 13 of a third embodiment according to the present invention. FIG. 8(*a*) is a side view of the gear flange 13. FIG. 8(*b*) is a front view of the gear flange 13.

The driven-side power transmission portion 5 of the present embodiment has the cylindrical body 3 and three engaging projections 14.

The engaging projections 14 are disposed at, for example, trisection points, the points being obtained by substantially equal division into three in the axial direction (the central shaft of the photosensitive drum 2), on the outer circumferential surface of the cylindrical body 3. The engaging projections 14 protrude radially outward from the outer circumference of the cylindrical body 3, away from the driving force receiving portion 9. The planar shape of the engaging projections 14 is shaped into an elliptic hemisphere as viewed radially outward.

The three engaging projections 14 are formed in the vicinity of the front edge 3*b* of the cylindrical body 3. The major axis of each elliptic engaging projection is formed in such a manner as to extend in a circumferential direction of the cylindrical body 3.

According to the present embodiment, the front edge 3*b* of the cylindrical body 3 reaches the bottom of the twisted engaging hole C, as a result of driving and rotating the apparatus drive shaft A using the electric motor B while pushing the apparatus drive shaft A against the cylindrical body 3. In so doing, the cylindrical body 3 is inserted into the twisted engaging hole C as the curved surfaces of the three engaging projections 14 of the driven-side power transmission portion 5 come into point-contact with the guide surfaces E on the inside of the triangular opening portion D of the twisted engaging hole C. In this manner, the cylindrical body 3 can easily be passed through the twisted engaging hole C with less sliding friction. Moreover, inserting the front edges of the engaging projections 14 into the twisted engaging hole C can bring about the pulling effect. The pulling effect can be improved by positioning the top portions of the engaging projections 14 in the vicinity of the front edge 3*b*.

In a state in which the front edge of the cylindrical body 3 reaches the bottom of the twisted engaging hole C, the engaging projections 14 that have a substantially elliptic hemispherical planar shape as viewed radially outward remain in point-contact with the guide surfaces E on the back of the triangular opening portion D of the twisted engaging hole C. For this reason, the rotational driving force of the apparatus drive shaft A can be transmitted to the gear flange 13 via the driven-side power transmission portion 5 configured by the three engaging projections 14 and the cylindrical body 3. The photosensitive drum 2 can be driven to rotate thereby.

Because the three elliptic engaging projections 14 of the present embodiment are disposed in such a manner that the major axes thereof extend in the circumferential direction of the cylindrical body 3 to enhance the rigidity in the rotational direction, the strength of the engaging projections 14 against the rotation of the cylindrical body 3 for transmitting the driving force can further be ensured.

Figure 9A:
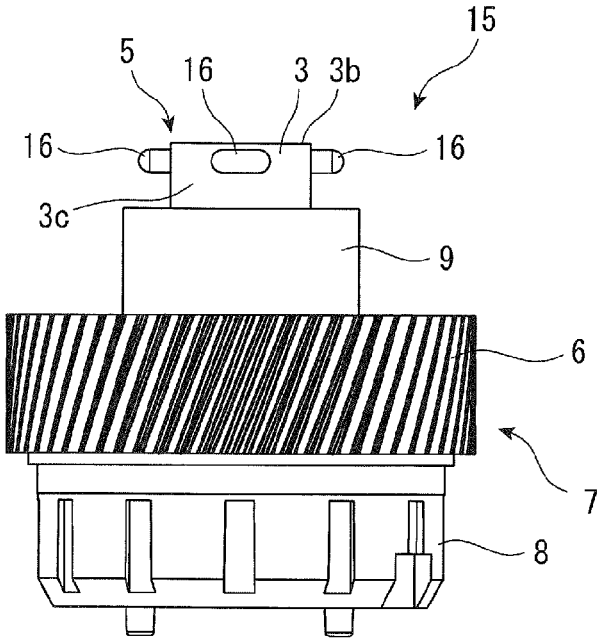
FIG. 9 shows a gear flange of a fourth embodiment according to the present invention, where FIG. 9(*a*) is a side view and FIG. 9(*b*) is a front view.
Figure 9B:
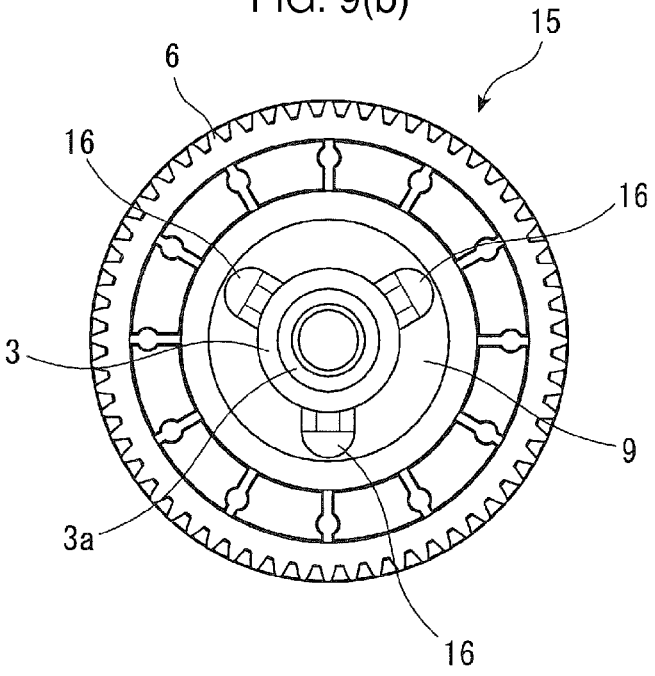

FIGS. 9(*a*) and 9(*b*) are diagrams showing a gear flange 15 of a fourth embodiment according to the present invention. FIG. 9(*a*) is a side view of the gear flange 15. FIG. 9(*b*) is a front view of the gear flange 15.

The driven-side power transmission portion 5 of the present embodiment has the cylindrical body 3 and three engaging projections 16.

The engaging projections 16 are disposed at, for example, trisection points, the points being obtained by substantially equal division into three in the axial direction (the central shaft of the photosensitive drum 2), on the outer circumferential surface of the cylindrical body 3. The engaging projections 16 protrude radially outward from the outer circumference of the cylindrical body 3, away from the driving force receiving portion 9. The planar shape of the engaging projections 16 is shaped into an elongated oval hemisphere as viewed radially outward.

The three engaging projections 16 are formed in the vicinity of the front edge 3*b* of the cylindrical body 3, and a longitudinal direction of each elongated oval engaging projection extends in the circumferential direction of the cylindrical body 3.

According to the present embodiment, the front edge 3*b* of the cylindrical body 3 reaches the bottom of the twisted engaging hole C, as a result of driving and rotating the apparatus drive shaft A using the electric motor B while pushing the apparatus drive shaft A against the cylindrical body 3. In so doing, the cylindrical body 3 is inserted into the twisted engaging hole C as the curved surfaces of the three engaging projections 16 of the driven-side power transmission portion 5 come into point-contact with the guide surfaces E on the inside of the triangular opening portion D of the twisted engaging hole C. In this manner, the cylindrical body 3 can easily be passed through the twisted engaging hole C with less sliding friction. Moreover, inserting the front edges of the engaging projections 16 into the twisted engaging hole C can bring about the pulling effect. The pulling effect can be improved by positioning the top portions of the engaging projections 16 in the vicinity of the front edge 3*b*.

In a state in which the front edge of the cylindrical body 3 reaches the bottom of the twisted engaging hole C, the engaging projections 16 that have a substantially elongated oval hemispherical planar shape as viewed radially outward remain in point-contact with the guide surfaces E on the back of the triangular opening portion D of the twisted engaging hole C. For this reason, the rotational driving force of the apparatus drive shaft A can be transmitted to the gear flange 15 via the driven-side power transmission portion 5 configured by the three engaging projections 16 and the cylindrical body 3. The photosensitive drum 2 can be driven to rotate thereby.

Because the three elongated oval engaging projections 16 of the present embodiment are disposed in such a manner that the longitudinal directions thereof extend in the circumferential direction of the cylindrical body 3 to enhance the rigidity in the rotational direction, the strength of the engaging projections 16 against the rotation of the cylindrical body 3 for transmitting the driving force can further be ensured.

Figure 10A:
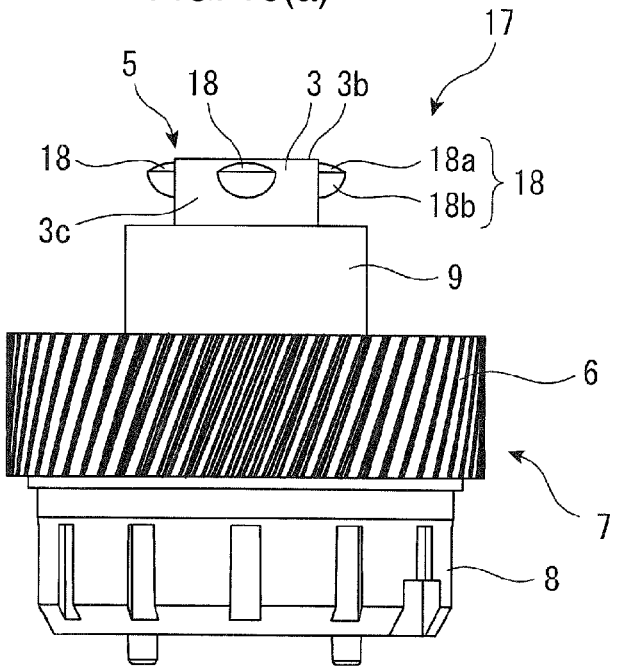
FIG. 10 shows a gear flange of a fifth embodiment of the present invention, where FIG. 10(*a*) is a side view and FIG. 10(*b*) is a front view.
Figure 10B:
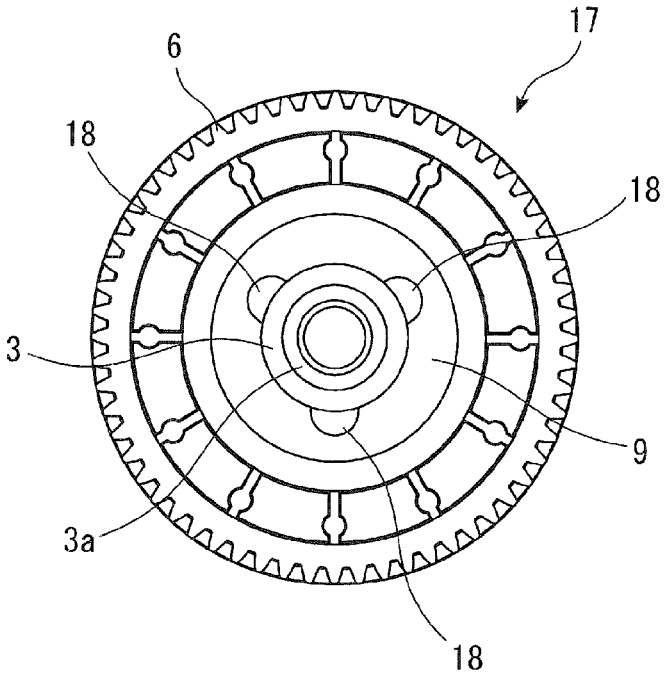

FIGS. 10(*a*) and 10(*b*) are diagrams showing a gear flange 17 of a fifth embodiment according to the present invention. FIG. 10(*a*) is a side view of the gear flange 17. FIG. 10(*b*) is a front view of the gear flange 17.

The driven-side power transmission portion 5 of the present embodiment has the cylindrical body 3 and three engaging projections 18.

The engaging projections 18 are disposed at, for example, trisection points, the points being obtained by substantially equal division into three in the axial direction (the central shaft of the photosensitive drum 2), on the outer circumferential surface of the cylindrical body 3. The engaging projections 18 protrude radially outward from the outer circumference of the cylindrical body 3, away from the driving force receiving portion 9.

Each of the engaging projections 18 is in the shape of a flat elliptic hemisphere that has a first curved surface 18*a* bulging on one side in the axial direction (upward in FIG. 9(*a*)) as viewed radially outward, and a second curved surface 18*b* having a curvature radius smaller than that of the first curved surface 18*a* and bulging on the other side in the axial direction (upward in FIG. 9(*a*)).

The three engaging projections 18 are formed in the vicinity of the front edge 3*b* of the cylindrical body 3. The major axis of each elliptic engaging projection extends in the circumferential direction of the cylindrical body 3.

According to the present embodiment, the front edge 3*b* of the cylindrical body 3 reaches the bottom of the twisted engaging hole C, as a result of driving and rotating the apparatus drive shaft A using the electric motor B while pushing the apparatus drive shaft A against the cylindrical body 3. In so doing, the cylindrical body 3 is inserted into the twisted engaging hole C as the curved surfaces of the three engaging projections 18 of the driven-side power transmission portion 5 come into point-contact with the guide surfaces E on the inside of the triangular opening portion D of the twisted engaging hole C. In this manner, the cylindrical body 3 can easily be passed through the twisted engaging hole C with less sliding friction. Moreover, inserting the front edges of the engaging projections 18 into the twisted engaging hole C can bring about the pulling effect. The pulling effect can be improved by positioning the top portions of the engaging projections 18 in the vicinity of the front edge 3*b*.

In a state in which the front edge of the cylindrical body 3 reaches the bottom of the twisted engaging hole C, the engaging projections 18 that are substantially flat elliptic hemispherical planar shape as viewed radially outward remain in point-contact with the guide surfaces E on the back of the triangular opening portion D of the twisted engaging hole C. For this reason, the rotational driving force of the apparatus drive shaft A can be transmitted to the gear flange 17 via the driven-side power transmission portion 5 configured by the three engaging projections 18 and the cylindrical body 3. The photosensitive drum 2 can be driven to rotate thereby.

Because the three elliptic engaging projections 18 of the present embodiment are disposed in such a manner that the major axes thereof extend in the circumferential direction of the cylindrical body 3 to enhance the rigidity in the rotational direction, the strength of the engaging projections 18 against the rotation of the cylindrical body 3 for transmitting the driving force can further be ensured.

Figure 11A:
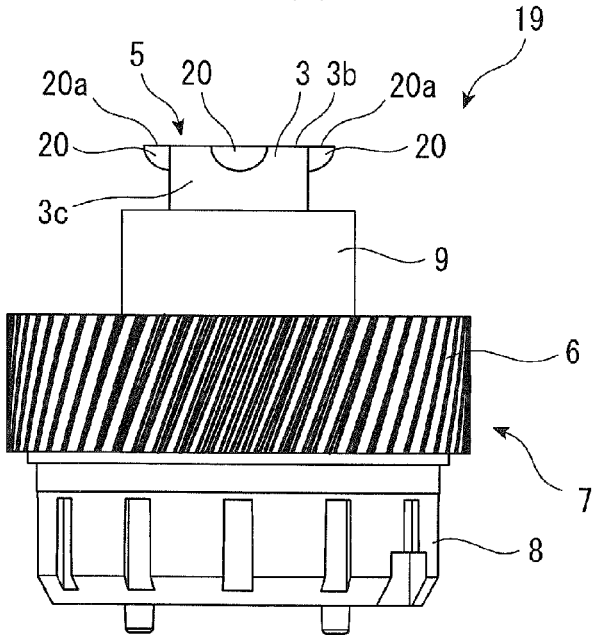
FIG. 11 is a gear flange of a sixth embodiment of the present invention, where FIG. 11(*a*) is a side view and FIG. 11(*b*) is a front view.
Figure 11B:
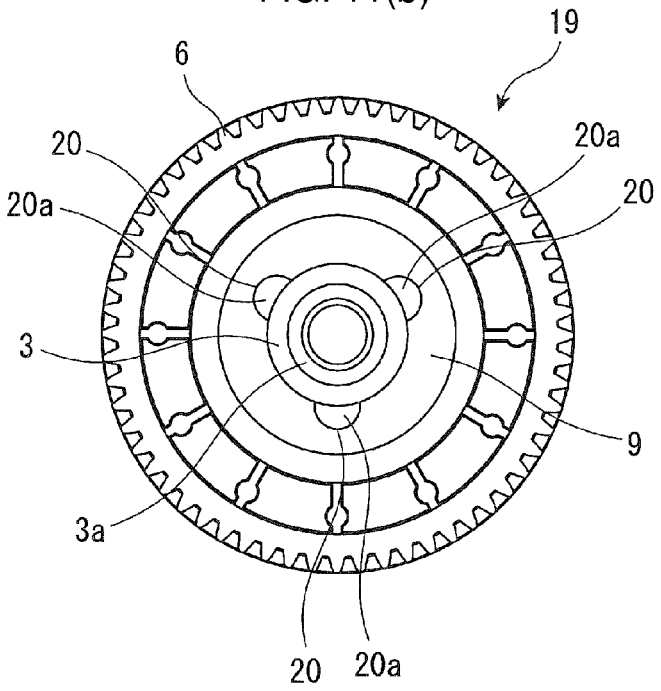

FIGS. 11(*a*) and 11(*b*) show a gear flange 19 of a sixth embodiment according to the present invention. FIG. 11(*a*) is a side view of the gear flange 19. FIG. 11(*b*) is a front view of the gear flange 19.

The driven-side power transmission portion 5 of the present embodiment has the cylindrical body 3 and three engaging projections 20.

The engaging projections 20 are disposed at, for example, trisection points, the points being obtained by substantially equal division into three in the axial direction (the central shaft of the photosensitive drum 2), on the outer circumferential surface of the cylindrical body 3. The engaging projections 20 protrude radially outward from the outer circumference of the cylindrical body 3, away from the driving force receiving portion 9. The planar shape of the engaging projections 20 is shaped into a semicircular hemisphere as viewed radially outward.

The engaging projections 20 are formed in such a manner that flat surface 20*a* thereof are flush with the front edge 3*b* of the cylindrical body 3.

According to the present embodiment, the front edge 3*b* of the cylindrical body 3 reaches the bottom of the twisted engaging hole C, as a result of driving and rotating the apparatus drive shaft A using the electric motor B while pushing the apparatus drive shaft A against the cylindrical body 3. In so doing, the cylindrical body 3 is inserted into the twisted engaging hole C as the curved surfaces of the three engaging projections 20 of the driven-side power transmission portion 5 come into point-contact with the guide surfaces E on the inside of the triangular opening portion D of the twisted engaging hole C. In this manner, the cylindrical body 3 can easily be passed through the twisted engaging hole C with less sliding friction. Moreover, inserting the front edges of the engaging projections 20 into the twisted engaging hole C can bring about the pulling effect. The pulling effect can be improved by positioning the top portions of the engaging projections 20 in the vicinity of the front edge 3*b*.

The embodiments described above are intended to show specific examples of the present invention. The present invention, therefore, is not limited to these embodiments and can be modified variously without departing from the spirit of the present invention. The first to sixth embodiments have described the gear flanges in each of which the gear 6 is formed on the outer circumference of the flange main body 7. However, the present invention can be applied to a flange 51 that has the driven-side power transmission portion 5 in the flange main body without a gear. In this case as well, the same operational effects as those of the gear flanges of the first to sixth embodiments can be achieved. The present invention can also be applied to a gear flange or flange in which the outer diameter of the cylindrical body 3 and the outer diameter of the driving force receiving portion 9 are substantially equal to each other. The term "hemisphere" includes not only a dome shape and a bell shape but also a three-dimensional shape that is formed with a curved surface obtained by flattening such a dome-shaped or bell-shaped surface in a radial direction thereof.

INDUSTRIAL APPLICABILITY

The present invention can provide electrophotographic photoreceptor that can not only exhibit enhanced rotational accuracy in an actual machine but also keep the rotational accuracy over a long period of time. This electrophotographic photoreceptor is capable of power transmission regardless of the direction of rotation of the drive-side power transmission portion and is excellent in terms of production cost.

The invention claimed is:

1. An electrophotographic photoreceptor, which is used by being detachably mounted onto an apparatus main body of an electrophotographic application apparatus while being incorporated in a process cartridge, the apparatus main body including a drive-side power transmission portion, the electrophotographic photoreceptor comprising:

a photosensitive drum including a cylindrical conductive substrate having an outer circumferential surface, and a photosensitive layer containing a photoconductive material on the outer circumferential surface; and a flange that is fitted to an edge of the photosensitive drum, the flange configured to transmit a rotational driving force from the drive-side power transmission portion to the photosensitive drum, the flange including a driving force receiving portion, and a driven-side power transmission portion configured to transmit the rotational driving force from the drive-side power transmission portion to the driving force receiving portion, the driven-side power transmission portion including a cylindrical body, a core of the cylindrical body being a central shaft of the photosensitive drum, the cylindrical body protruding from the driving force receiving portion, and a plurality of hemispherical engaging projections that are disposed at each trisection point of an outer circumference of the cylindrical body in such a manner so as to protrude in a radially outward direction from the outer circumference, away from the driving force receiving portion, and to be configured to come into engagement with the drive-side power transmission portion, circumferences of the hemispherical engaging projections being disposed in direct contact with the cylindrical body.

2. The electrophotographic photoreceptor according to claim 1, wherein the drive-side power transmission portion has an engaging hole provided at a central portion thereof, the engaging hole having a triangular cross section, further wherein the engaging projections engage a surface of the engaging hole to rotate the photosensitive drum.

3. The electrophotographic photoreceptor according to claim 2, wherein a first engaging projection of the engaging projections is provided in a vicinity of a front edge of the cylindrical body, a second engaging projection of the engaging projections is provided closer to a base portion of the cylindrical body relative to the first engaging projection, and a third engaging projection of the engaging projections is provided closer to the base portion of the cylindrical body than the second engaging projection.

4. The electrophotographic photoreceptor according to claim 2, wherein the engaging projections are provided in a vicinity of a front edge of the cylindrical body.

5. The electrophotographic photoreceptor according to claim 2 wherein the drive-side power transmission portion includes an alignment projection provided in a central portion of the engaging hole, further wherein an inner circumferential surface of the cylindrical body is formed into a shape so as to be able to come into engagement with an outer circumferential surface of the alignment projection.

6. The electrophotographic photoreceptor according to claim 5, wherein the alignment projection forms a circular, truncated cone, and the inner circumferential surface of the cylindrical body forms a cone shape to engage with the circular, truncated cone.

7. The electrophotographic photoreceptor according to claim 1, wherein the drive-side power transmission portion has a spiral, engaging hole provided at a central portion thereof, the engaging hole having a triangular cross section, further wherein the engaging projections engage a surface of the engaging hole to rotate the photosensitive drum.

8. The electrophotographic photoreceptor according to claim 1, wherein the flange is a gear flange.

9. An electrophotographic photoreceptor, which is used by being detachably mounted onto an apparatus main body of an electrophotographic application apparatus while being incorporated in a process cartridge, the apparatus main body including a drive-side power transmission portion, the electrophotographic photoreceptor comprising:

a photosensitive drum including a cylindrical conductive substrate having an outer circumferential surface, and a photosensitive layer containing a photoconductive material on the outer circumferential surface; and a flange that is fitted to an edge of the photosensitive drum, the flange configured to transmit a rotational driving force from the drive-side power transmission portion to the photosensitive drum, the flange including a driving force receiving portion, and a driven-side power transmission portion configured to transmit the rotational driving force from the drive-side power transmission portion to the driving force receiving portion, the driven-side power transmission portion including a cylindrical body, a core of the cylindrical body being a central shaft of the photosensitive drum, the cylindrical body protruding from the driving force receiving portion, and a plurality of engaging projections that are disposed at each trisection point of an outer circumference of the cylindrical body in such a manner so as to protrude in a radially outward direction from the outer circumference, away from the driving force receiving portion, and to be configured to come into engagement with the drive-side power transmission portion, the engaging projections each having an elliptic, planar shape as viewed in a radially outward direction of the cylindrical body, major axes of the elliptic, planar shapes of the engaging projections extending in a circumferential direction of the cylindrical body, the drive-side power transmission portion having a spiral, engaging hole provided at a central portion thereof, the engaging hole having a triangular cross section, the engaging projections being configured to engage with a surface of the engaging hole to rotate the photosensitive drum.

10. The electrophotographic photoreceptor according to claim 9, wherein for each of the engaging projections, an intersection of the major axis and a minor axis of the elliptic shape thereof is located near a front edge of the cylindrical body.

11. The electrophotographic photoreceptor according to claim 9, wherein the flange is a gear flange.

12. An electrophotographic photoreceptor, which is used by being detachably mounted onto an apparatus main body of an electrophotographic application apparatus while being incorporated in a process cartridge, the apparatus main body including a drive-side power transmission portion, the electrophotographic photoreceptor comprising:

a photosensitive drum including a cylindrical conductive substrate having an outer circumferential surface, and a photosensitive layer containing a photoconductive material on the outer circumferential surface; and a flange that is fitted to an edge of the photosensitive drum, the flange being configured to transmit a rotational driving force from the drive-side power transmission portion to the photosensitive drum, the flange including a driving force receiving portion, and a driven-side power transmission portion configured to transmit the rotational driving force from the drive-side power transmission portion to the driving force receiving portion, the driven-side power transmission portion including a cylindrical body, a core of the cylindrical body being a central shaft of the photosensitive drum, the cylindrical body protruding from the driving force receiving portion, and a plurality of engaging projections that are disposed at each trisection point of an outer circumference of the cylindrical body in such a manner so as to protrude in a radially outward direction from the outer circumference, away from the driving force receiving portion, and to be configured to come into engagement with the drive-side power transmission portion, the engaging projections each having elongated, oval, planar shapes as viewed in a radially outward direction of the cylindrical body, longitudinal directions of the elongated, oval, planar shapes of the engaging projections extending in a circumferential direction of the cylindrical body, the drive-side power transmission portion has a spiral, engaging hole provided at a central portion thereof, the engaging hole having a triangular cross section, the engaging projections being configured to engage with a surface of the engaging hole to rotate the photosensitive drum.

13. The electrophotographic photoreceptor according to claim 12, wherein the flange is a gear flange.

14. An electrophotographic photoreceptor, which is used by being detachably mounted onto an apparatus main body of an electrophotographic application apparatus while being incorporated in a process cartridge, the apparatus main body including a drive-side power transmission portion, the electrophotographic photoreceptor comprising:

a photosensitive drum including a cylindrical conductive substrate having an outer circumferential surface, and a photosensitive layer containing a photoconductive material on the outer circumferential surface; and a flange that is fitted to an edge of the photosensitive drum, the flange being configured to transmit a rotational driving force from the drive-side power transmission portion to the photosensitive drum, the flange including a driving force receiving portion, and a driven-side power transmission portion configured to transmit the rotational driving force from the drive-side power transmission portion to the driving force receiving portion, the driven-side power transmission portion including a cylindrical body, a core of the cylindrical body being a central shaft of the photosensitive drum, the cylindrical body protruding from the driving force receiving portion, and a plurality of engaging projections that are disposed at each trisection point of an outer circumference of the cylindrical body in such a manner so as to protrude in a radially outward direction from the outer circumference, away from the driving force receiving portion, and to be configured to come into engagement with the drive-side power transmission portion, the engaging projections each having a semicircular, planar shape as viewed in a radially outward direction of the cylindrical body, the drive-side power transmission portion has a spiral, engaging hole provided at a central portion thereof, the engaging hole having a triangular cross section, the engaging projections being configured to engage with a surface of the engaging hole to rotate the photosensitive drum.

15. The electrophotographic photoreceptor according to claim 14, wherein the flange is a gear flange.

* * * * *